US009051700B2

(12) United States Patent
Summers et al.

(10) Patent No.: US 9,051,700 B2
(45) Date of Patent: Jun. 9, 2015

(54) V-BLADE SNOWPLOW HAVING DUAL TRIP MECHANISM

(71) Applicant: THE TORO COMPANY, Bloomington, MN (US)

(72) Inventors: Tristan Summers, Iron Mountain, MI (US); Jody Christy, Iron Mountain, MI (US)

(73) Assignee: THE TORO COMPANY, Bloomington, MN (US)

( * ) Notice: Subject to any disclaimer, the term of this patent is extended or adjusted under 35 U.S.C. 154(b) by 0 days.

(21) Appl. No.: 13/783,206

(22) Filed: Mar. 1, 2013

(65) Prior Publication Data

US 2013/0232827 A1 Sep. 12, 2013

Related U.S. Application Data

(60) Provisional application No. 61/607,307, filed on Mar. 6, 2012.

(51) Int. Cl.
*E01H 5/06* (2006.01)

(52) U.S. Cl.
CPC ..... *E01H 5/062* (2013.01); *E01H 5/063* (2013.01)

(58) Field of Classification Search
CPC ..... E01H 5/06; E01H 5/061; E01H 5/062; E01H 5/063; E01H 5/066; E01H 5/068
USPC ..... 37/231–233, 272–274, 280, 264–267, 37/270, 271; 172/811, 816, 261–265, 705
See application file for complete search history.

(56) References Cited

U.S. PATENT DOCUMENTS

| | | | | | |
|---|---|---|---|---|---|
| 1,891,046 | A | | 12/1932 | Gettleman | |
| 2,055,291 | A | * | 9/1936 | Henry | 37/233 |
| 3,772,803 | A | * | 11/1973 | Cote | 37/233 |
| 4,074,448 | A | * | 2/1978 | Niemela | 37/234 |
| 4,384,620 | A | * | 5/1983 | Uchida et al. | 172/815 |
| 4,597,202 | A | * | 7/1986 | Weeks | 37/232 |
| 4,907,358 | A | * | 3/1990 | Moore | 37/232 |
| 5,437,113 | A | * | 8/1995 | Jones | 37/233 |
| 5,697,172 | A | * | 12/1997 | Verseef | 37/232 |
| 7,743,536 | B2 | * | 6/2010 | Evans et al. | 37/274 |
| 2006/0107555 | A1 | | 5/2006 | Curtis | |

OTHER PUBLICATIONS

Meyer® product fact sheet, ©2006, illustrating snowplows with separate "Diamond Edge" bottom-trip and Aggressor® full-trip capabilities.

Meyer® Road-Pro™ product fact sheet, ©2010, illustrating snowplows with separate bottom-trip and full-trip capabilities.

* cited by examiner

*Primary Examiner* — Robert Pezzuto
(74) *Attorney, Agent, or Firm* — Marshall, Gerstein & Borun LLP

(57) ABSTRACT

A V-blade snowplow having both full moldboard trip and trip edge capabilities. The V-blade has first and second moldboards that not only can pivot against a restoring force of one or more trip springs extending intermediate a pivot frame and a push frame of the snowplow, but the moldboard of each wing of the V-plow has associated therewith a respective cutting edge hingedly secured along a base thereof, the cutting edge biased toward an untripped position in substantial alignment with the base of the moldboard by one or more trip edge springs. The maximum angle of deflection of the cutting edges is preferably about 40°, which is lower than the maximum angle of deflection of cutting edges of V-plows only exhibiting trip edge capability.

24 Claims, 12 Drawing Sheets

V-BLADE SNOWPLOW HAVING DUAL TRIP MECHANISM

REFERENCE TO RELATED APPLICATION

This application claims the benefit of the filing date of U.S. provisional application No. 61/607,307, filed Mar. 6, 2012, the entirety of which is incorporated herein by reference.

BACKGROUND

1. Field of the Disclosure

This disclosure relates generally to trip mechanisms for snowplows and, more specifically, to V-blade snowplows having a dual trip mechanism.

2. Related Technology

Generally speaking, snowplow blades come in two different types, a straight blade and an adjustable or V-blade. The straight blade generally extends across the front of a vehicle, such as a truck. Some straight blades may be angularly adjustable relative to the longitudinal axis of the vehicle. For example, some straight blades may have the capability to angle the straight blade relative to the longitudinal axis of the vehicle. While straight blades generally push snow well, they are not very adaptable to plowing confined areas or odd-shaped areas.

V-blade snowplows, on the other hand, are more adaptable. V-blades are formed by two wings or blades (a driver's side blade or left wing, and a passenger's side blade or right wing) that meet at a center hinge. Each blade may be independently adjustable relative to the longitudinal axis of the vehicle. As a result, the V-blade may have multiple useful configurations. For example, the V-blade may take on a V-shape with each blade extending at an angle from the center hinge, rearwardly toward the vehicle. The V-blade may also take on an inverted V-shape or scoop configuration, where each blade extends at an angle forward from the center hinge, away from the vehicle. Finally, the V-blade may mimic a straight blade by having one blade extend forward from the center hinge and another blade extending rearward from the center hinge. As a result of the different configurations, the V-blade is known to be generally more adaptable to unique plow areas, especially confined plow areas.

In practice, areas to be snow plowed are rarely flat and level. To the contrary, most plowing areas have uneven terrain and even obstacles extending upward from the plowing surface, such as curbs, manhole covers, reflectors, ADA-mandated tactile warning tiles, and other objects. Snowplow blades must have the capability to adjust to the uneven terrain and to overcome the obstacles without breaking the obstacle or the blade. When a snowplow blade meets an obstacle, it "trips" in one or more directions to allow the blade, or a portion of the blade, to adjust so that the snowplow blade may pass over the obstacle. Generally, there are two types of trip mechanisms: An edge trip mechanism and a full blade trip mechanism.

In edge trip mechanisms, a cutting edge strip is hingedly attached along the bottom edge of a main blade or moldboard. The cutting edge strip is biased forward, into general alignment with the bottom of the moldboard, by one or more springs. When an obstacle is encountered, and enough force is generated to overcome the spring bias, the cutting edge strip pivots rearward, allowing the main blade to pass over the obstacle. Once the obstacle has been passed over, the spring-biased cutting edge strip returns, due to the spring bias, to its normal untripped position. The cutting edge strip is typically made of a sacrificial material, such that it is slowly worn away during the plowing process through friction with the plowing surface. As the sacrificial material wears down, the maximum obstacle clearance height is slowly reduced because the maximum height of the cutting edge strip is reduced. Eventually, the user must replace the cutting edges. One drawback of the edge trip mechanisms is that they are obstacle height-limited. In other words, if an obstacle is encountered that is higher than the thin cutting edge strip, the obstacle will contact the main blade (even if the thin cutting edge strip rotates out of the way). Such an encounter can cause damage to the main blade, the blade mounting hardware, and/or the vehicle itself.

In full blade trip mechanisms, the full blade assembly is pivotably mounted to the vehicle. The pivot axis is generally located above the top of the cutting edge. One or more trip springs bias the two moldboards and their respective cutting edges (which, in conventional V-blade plows, were fixedly-, as opposed to hingedly-, secured to the base of the respective moldboards) into a plowing position. When an obstacle is encountered, and the trip spring bias is overcome, the full blade assembly pivots about the pivot axis, which causes the full moldboards to rotate rearward and upward, thereby clearing the obstacle. As with the cutting edges of edge trip mechanisms, once the obstacle has been cleared, the full moldboards return to their original, un-tripped position. While the full blade trip mechanism generally is capable of clearing relatively high obstacles, the force required to overcome the spring bias is greater than edge trip mechanisms, which causes greater impact forces to be transferred to the vehicle. These greater impact forces can be unpleasant for a driver and any other occupants of the vehicle.

DETAILED DESCRIPTION OF THE PREFERRED EMBODIMENT

Figure 1:
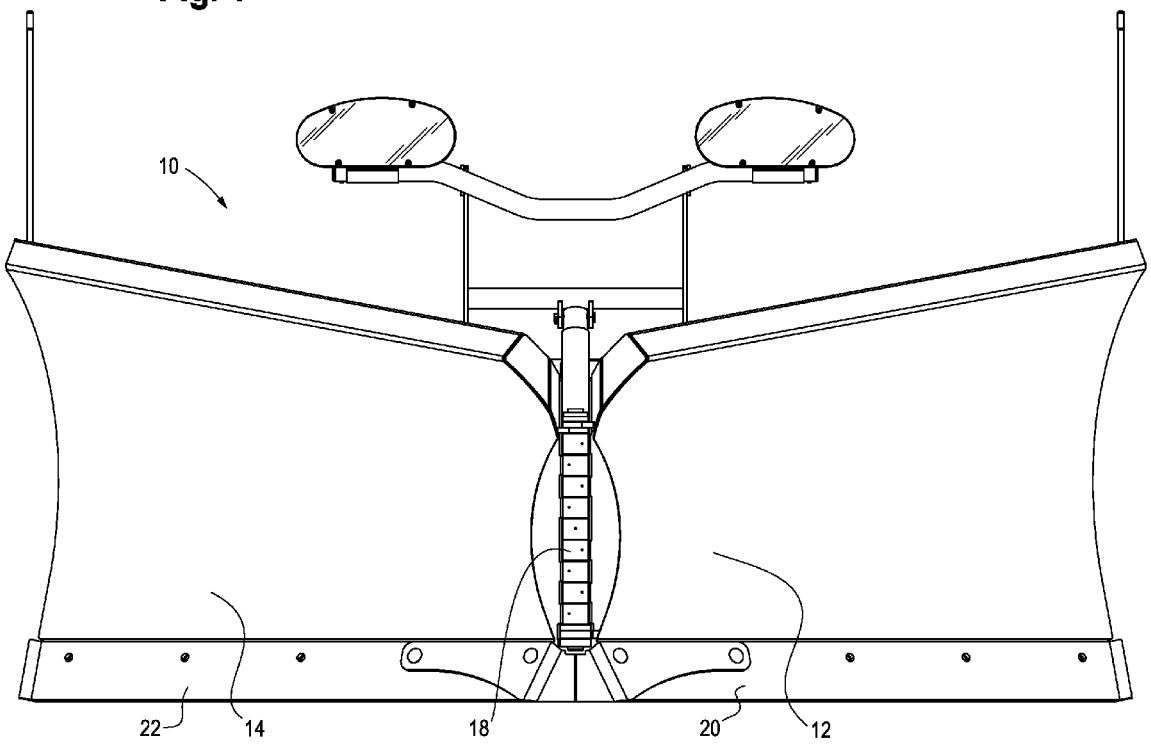
FIG. 1 is a front plan view of a V-blade snowplow of the present disclosure.

U.S. Pat. Nos. 4,658,519 and 7,437,839, the entire disclosures of which are incorporated herein by reference, disclose V-blade snowplows. The V-blade snowplow 10 of the present disclosure employs the main components of those patents, as well as enhancements that provide the V-blade snowplow 10 with both trip edge as well as full moldboard trip capabilities. While V-blade snowplows have been manufactured in the past with either trip edge capability or full moldboard trip capability, heretofore there has yet to be a V-blade snowplow that successfully offered both trip edge and full moldboard trip.

The V-blade snowplow 10 includes a left or first wing having a first moldboard 12 and a right or second wing a second moldboard 14, both of which are secured to a pivot frame 16 by a central hinge 18. A first cutting edge 20 is associated with the first moldboard 12, and a second cutting edge 22 is associated with the second moldboard 14. Each of the first and second cutting edges 20, 22 may include a sacrificial element of the V-blade snowplow 10, in that it is made of a material intended to wear down over time without compromising the integrity of the respective first and second moldboards 12, 14.

Figure 2:
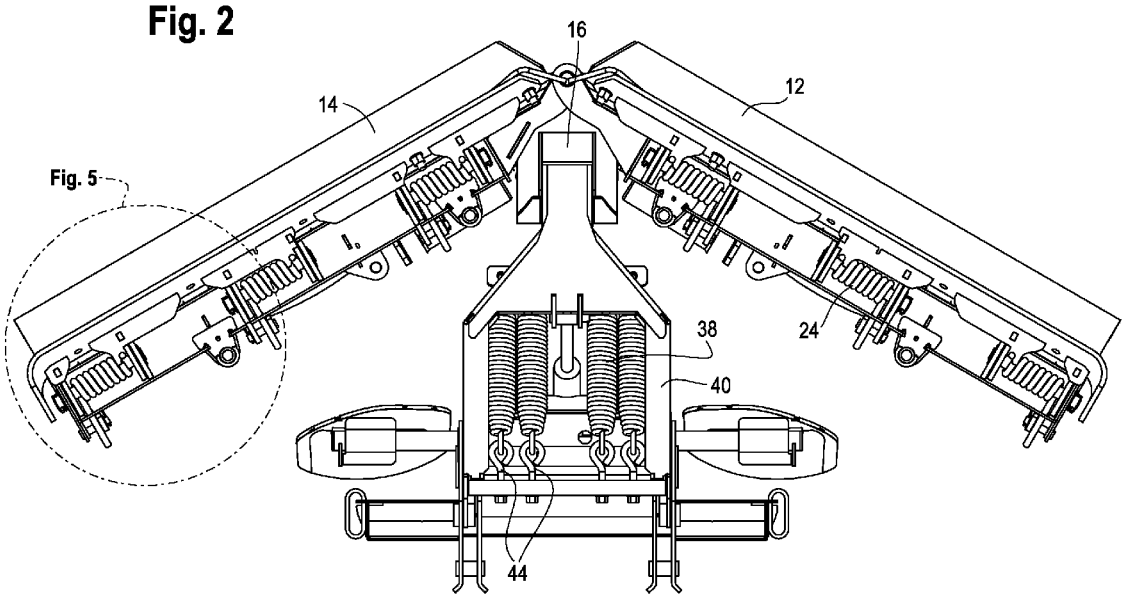
FIG. 2 is a bottom view of the V-blade snowplow of FIG. 1, illustrating a plurality of torsion springs that provide the snowplow with trip edge capability.
Figure 3:
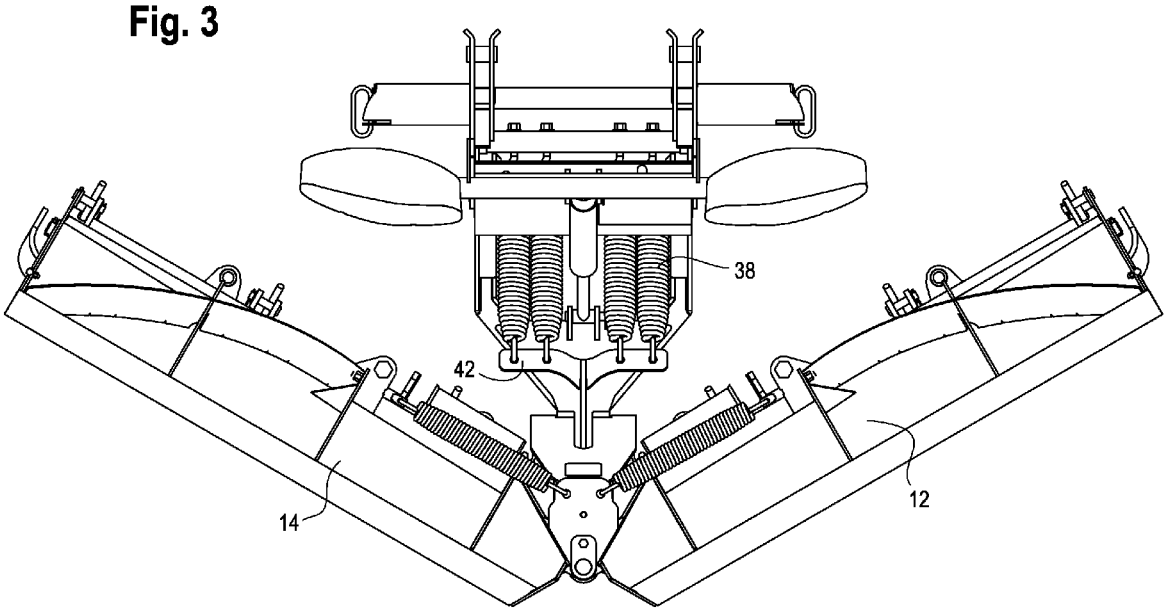
FIG. 3 is a top view of the V-blade snowplow of FIG. 1, illustrating a plurality of trip springs that provide the snowplow with full moldboard trip capability.
Figure 4:
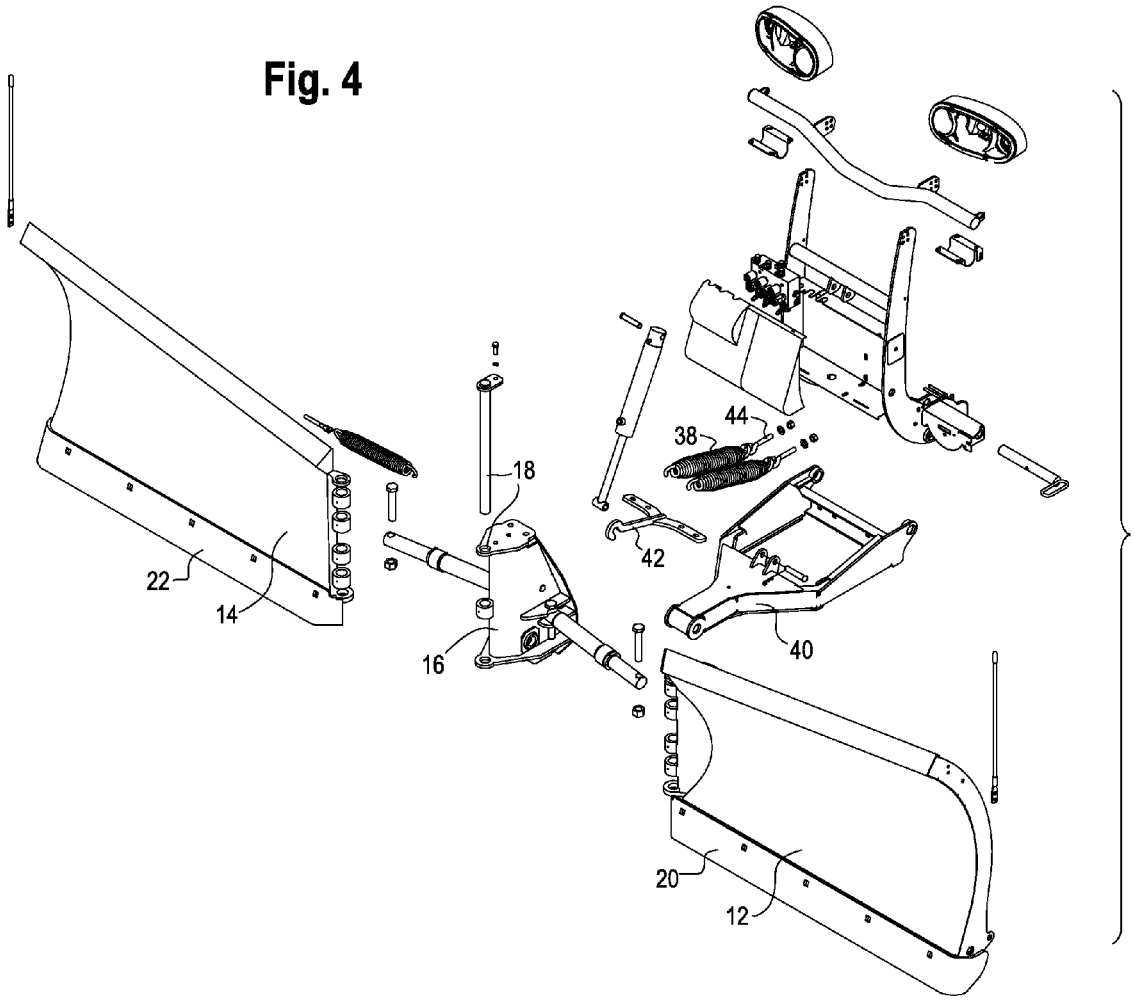
FIG. 4 is a partially-exploded front perspective view of the V-blade snowplow of FIG. 1.
Figure 5:
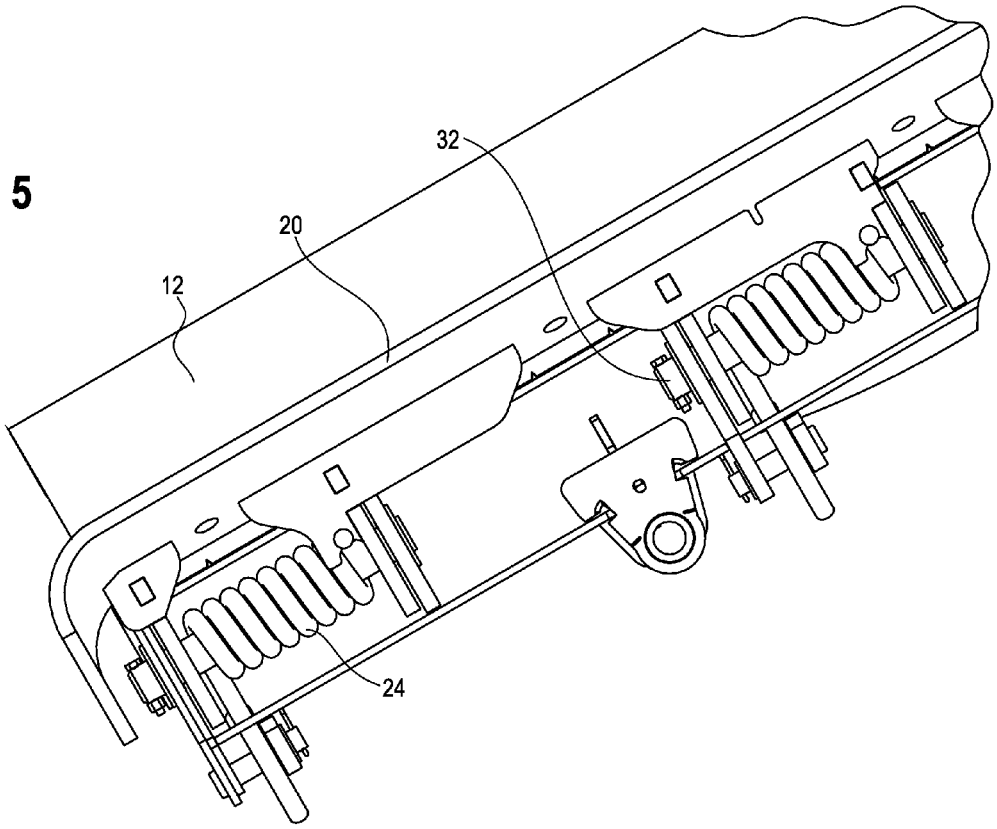
FIG. 5 is an enlarged bottom view of the V-blade snowplow of FIG. 1, of the region identified as "FIG. 5" in FIG. 2.
Figure 6:
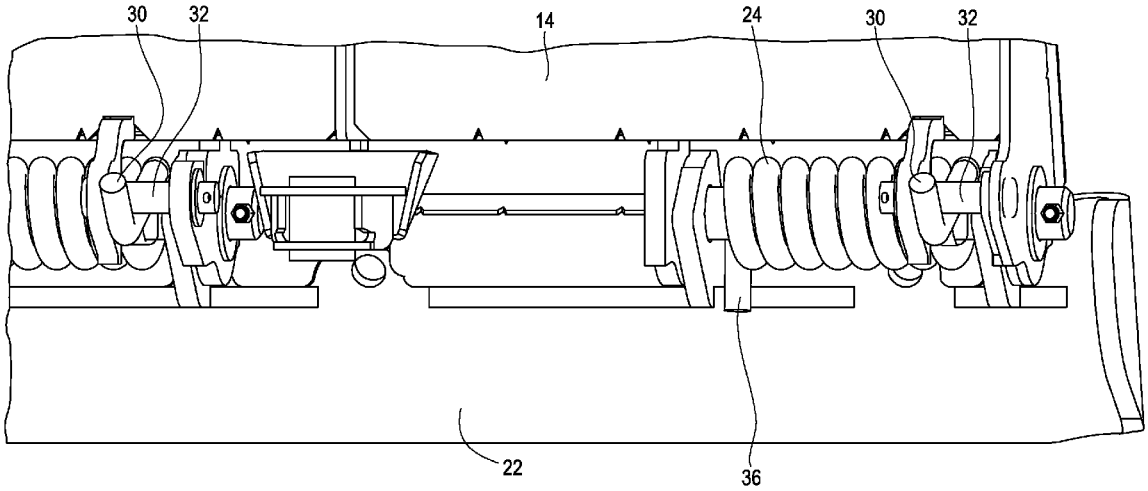
FIG. 6 is an enlarged rear view of a lower portion of a right wing of the V-blade snowplow of FIG. 1.
Figure 7:
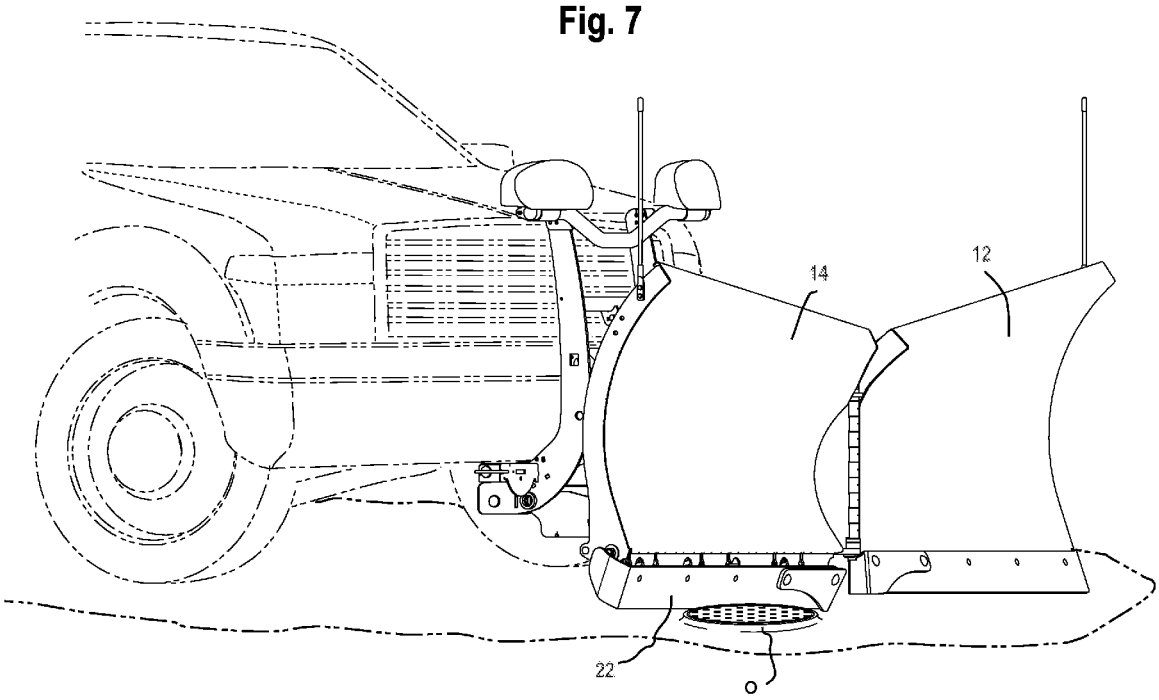
FIG. 7 is a front perspective view of the V-blade snowplow of FIG. 1 mounted to a truck (shown in broken lines), immediately after making contact with an immovable obstacle on a roadway being plowed, the obstacle having a height lower than a height of the cutting edges, depicting the first (right) cutting edge, that made contact with the immovable object, displaced relative to the base of the respective moldboard.
Figure 8:
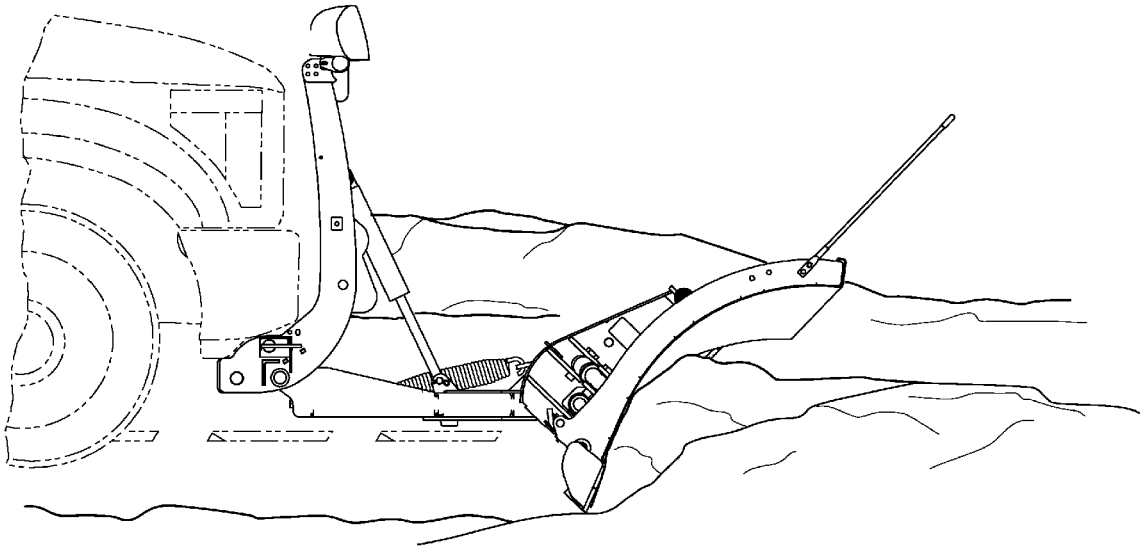
FIG. 8 is a right side view of the V-blade snowplow of FIG. 1 mounted to a truck (shown in broken lines), with the full moldboard tripped as a result of contact with a snow bank.
Figure 9:
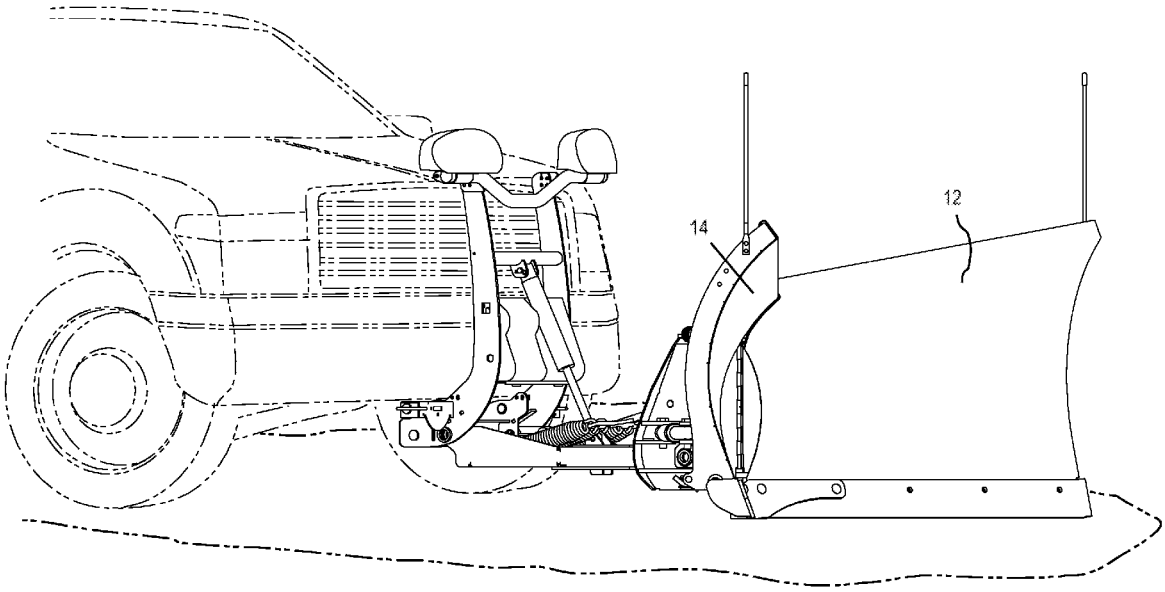
FIG. 9 is a front-right side of the V-blade snowplow of FIG. 1 mounted to a truck (shown in broken lines), with the blades of the snowplow oriented in a scoop position.
Figure 10:
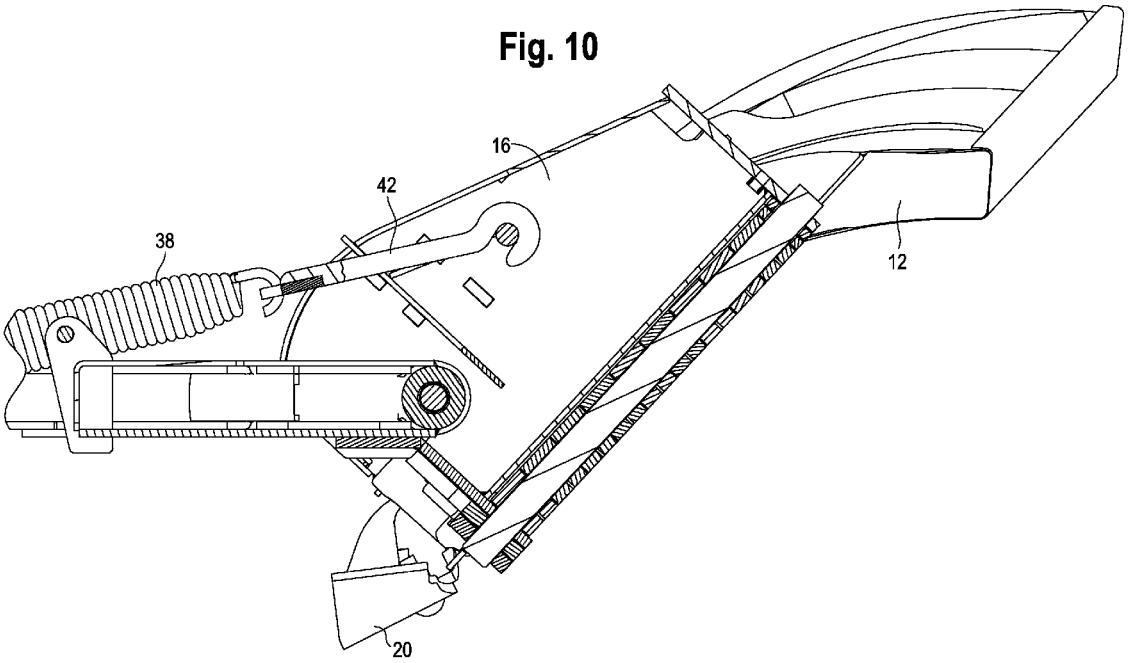
FIG. 10 is a cross-section of the V-blade snowplow of FIG. 1, with both trip mechanisms, i.e. the cutting edge trip and the full moldboard trip, fully engaged.
Figure 11:
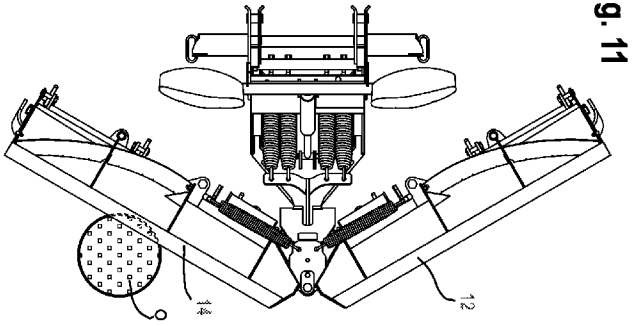
FIG. 11 is a top view of the V-blade snowplow of FIG. 1 in a V position, immediately after a cutting edge of the right wing thereof making contact with an immovable obstacle on a roadway being plowed, the obstacle having a height lower than a height of the cutting edges, depicting the first (right) cutting edge, that made contact with the immovable object, displaced relative to the base of the respective moldboard.
Figure 12:
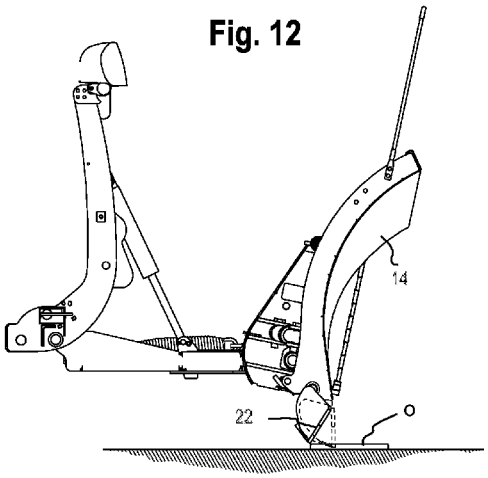
FIG. 12 is a right side view of the V-blade snowplow of FIG. 11 illustrating the first (right) cutting edge tripping from a first orientation substantially coplanar with a lower section of the respective moldboard to an angled orientation relative to the lower section of the respective moldboard upon impact with an immovable object.
Figure 13:
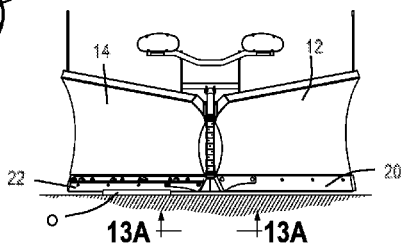
FIG. 13 is a front view of the V-blade snowplow of FIG. 11.
Figure 13A:
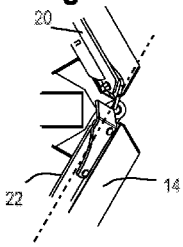
FIG. 13A is a bottom view taken along lines 13A-13A of FIG. 13, illustrating one of the cutting edges in a tripped condition due to impact with an immovable object and the other of the cutting edges in an untripped condition.
Figure 14:
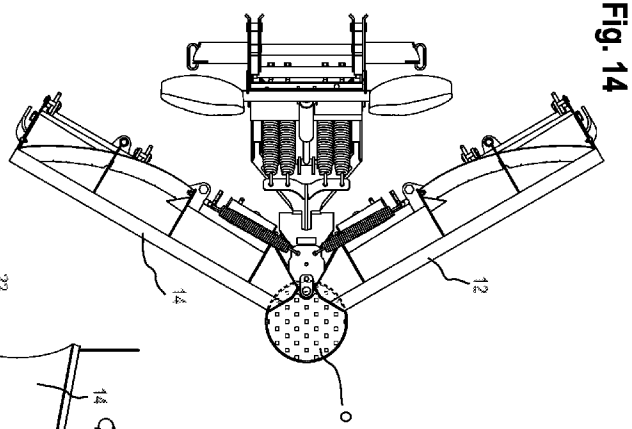
FIG. 14 is a top view of the V-blade snowplow of FIG. 1 similar to FIG. 11, but immediately after the cutting edges of both wings making contact with a substantially centered obstacle on a roadway being plowed, the obstacle having a height lower than a height of the cutting edges.

Each of the first and second cutting edges 20, 22 is hingedly mounted to its respective moldboard 12, 14 by a plurality of trip edge springs 24 (see FIG. 5). While tension coil springs have been employed in conventional V-plows that exhibit only trip edge capability, the springs 24 utilized to hingedly connect the first and second cutting edges 20, 22 to the respective first and second moldboards 12, 14 of the V-blade snowplow 10 of the present disclosure are torsion trip edge springs 24 that are disposed along the respective axes of rotation 26, 28 of the first cutting edge 20 relative to a lower edge of the first moldboard 12, and of the second cutting edge 22 relative to a lower edge of the second moldboard 14. A first end 30 of each trip edge spring 24 is secured by an anchor pin assembly 32 to a moldboard support frame 34 of the respective moldboard 12, 14. This section of the moldboard support frame 34 preferably defines a bottom channel 35 therein (see FIG. 6, where the moldboard support frame 34 is omitted for clarity), and the moldboard support frame 34 at least partially shields the torsion trip edge springs 24 and anchor pin assemblies 32 from snow, ice, and other debris. A second end 36 of each trip edge spring 24 is secured to a rear (i.e., truck-facing) side of the respective cutting edge 20, 22. This is illustrated in FIGS. 1 and 6. The collective restoring torque of the plurality of torsion trip edge springs 24 between a given one of the cutting edges 20, 22 and its respective moldboard 12, 14 biases the associated cutting edge 20, 22 toward its un-tripped position. Preferably, three torsion trip edge springs 24 are provided in parallel (i.e., along the same hinge axis) between each of the cutting edges 20, 22 and its respective moldboard 12, 14, for a total of six torsion trip edge springs 24, as illustrated in FIG. 2.

The first and second cutting edges 20, 22 may each include a plurality of bolt-receiving apertures 21 along an upper edge thereof to facilitate removable securement of replacement cutting edges (not shown) to the first and second cutting edges 20, 22. In this manner, a snowplow owner need not detach the first and second cutting edges 20, 22 from the torsion trip edge springs 24 when the original factory-installed cutting edges wear to an appreciable extent, but instead, can simply bolt replacement sacrificial edges to the remaining hingedly-attached portions of the original cutting edges 20, 22.

The selection of stiffness of trip edge springs 24, as well as the stiffness of trip springs 38 for full moldboard trip, is guided in major part by a trade-off between the desire to enable the cutting edge of the snowplow to trip upon contact with an immovable object on a roadway being plowed, on the one hand, and the desire to avoid the edge (or the full moldboard) tripping when plowing heavy, wet snow and ice. By providing both trip edge and full moldboard trip capabilities in a single V-blade assembly, the V-blade snowplow 10 of the present disclosure can utilize stiffer trip springs (preferably four trip springs 38 mounted in parallel) for the full moldboard trip (as compared to trip springs of conventional full moldboard trip-only V-blade snowplows), and stiffer trip edge springs 24, (as compared to conventional trip edge-only V-blade snowplows) without increasing forces transferred to a cab of a truck to which the V-blade snowplow 10 is secured. This is due to the fact that the full moldboard trip capability and the trip edges provide back-up to one another—a stiffer moldboard that is less susceptible to tripping due to heavy snow will still, due to the provision of trip edges, mitigate the translation of forces to the truck cab from impacts with stationary objects on a roadway being plowed (provided the height of those objects is no higher than the height of the cutting edges). By way of example only, a suitable stiffness or spring rate for each of the torsion trip edge springs 24 for the V-blade snowplow of the present disclosure is 68 lb.-in./deg., but could be higher, or lower, and a suitable stiffness or spring rate for each of the trip springs 38, which are extension springs as opposed to torsion springs, is 145 lb./in, but could be higher, or lower.

In utilizing the dual trip mode capability of the present disclosure, impact testing has reflected a significant reduction in forces transferred to the vehicle as compared to vehicles provided with snowplows having only edge trip capability.

More specifically, between speeds of 5 to 14 miles per hour, with 14 MPH being an industry-standard recommended maximum plowing speed, a V-blade snowplow 10 of the present disclosure having dual trip mode capability experiences an average reduction of 65% of the force transferred to the vehicle when impacting an object with the cutting edge 20 or 22 near an outside end of the snowplow blade 12 or 14.

The four trip springs 38 are mounted in parallel between an upper rear portion of a push frame 40 and a generally-horizontally extending elongate portion of a hanger bar 42, which hanger bar 42 is secured to a rear portion of the central hinge 18. A turnbuckle 44 may be provided intermediate each of the trip springs 38 and the push frame 40.

Advantageously, the full moldboard trip capability of the V-blade snowplow 10 of the present disclosure gives the snowplow the ability to trip, and thereby mitigate translation of forces upon impacts with objects of a height that is greater than the cutting edge. This is of particular concern to V-blade snowplow operators as the cutting edges of the snowplow wear down, as the height of immovable objects over which cutting edges of a trip edge-only V-plow can clear diminishes as the cutting edges wear down and lose their overall height.

Another drawback of conventional trip edge-only V-plow snowplows is that the angle of rotation of conventional cutting edges when tripped in a direction rearward from the contour of the front of the moldboard is so great, typically at least about 60°, that the cutting edges are susceptible to being stuck in their tripped condition by snow, ice, dirt, or other debris caught between the top of the cutting edge and the base of the moldboard. Because the trip edge capability is not the only means for the V-blade snowplow 10 to trip when striking an object, the cutting edges 20, 22 need not rotate rearward from the contour of the respective moldboards 12, 14 as much as conventional trip edges. For instance, the plurality of torsion trip edge springs 24 are preferably selected and mounted so as to permit an angle of rotation of the cutting edges 20, 22 relative to the respective moldboards 12, 14 in the range of about 30° to about 40°, and preferably about 40°, i.e. about 20° smaller of an angle of rotation than the typical angle of maximum deflection of trip edge-only V-plow cutting edges. As a result, less snow, ice, or other debris can enter the region between the tripped cutting edge 20, 22 and the base of the respective moldboard 12, 14. Moreover, by reducing the maximum degree of deflection through which the cutting edges 20, 22 rotate from a rest condition to a fully-tripped condition, the fatigue on the trip edge springs 24 is reduced. As explained above, the smaller degree of maximum deflection of the cutting edges 20, 22 also permits the use of stiffer trip edge springs 24.

Figure 15:
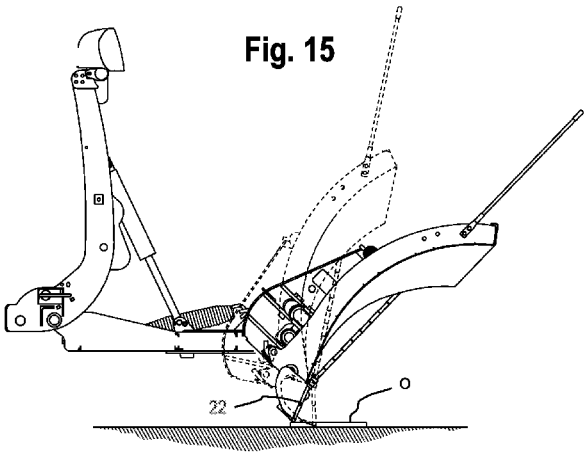
FIG. 15 is a right side view of the V-blade snowplow of FIG. 14 similar to FIG. 12, but illustrating neither of the cutting edges tripping but illustrating a full moldboard trip upon impact with the substantially centered obstacle on a roadway being plowed.
Figure 16:
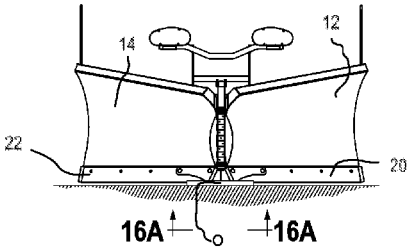
FIG. 16 is a front view of the V-blade snowplow of FIG. 14.
Figure 16A:
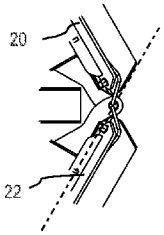
FIG. 16A is a bottom view taken along lines 16A-16A of FIG. 16, similar to FIG. 13A, but illustrating neither of the cutting edges tripping, due to the fact that the orientation of the cutting edges causes them to bind on one another upon impact with a substantially centered obstacle or upon simultaneous impacts with a plurality of obstacles, thereby preventing them from tripping.

An additional drawback of conventional trip edge-only V-plow snowplows is that such snowplows, when the wings are arranged in a V, have diminished ability to trip in response to a center impact with an object having a height less than the height of the cutting edges (or even off-center impacts that would cause both cutting edges to trip simultaneously) due to the cutting edges at least momentarily binding with one another at the plow center while attempting to rotate. The V-blade snowplow 10 of the present disclosure, with its dual trip capability, advantageously supplies the full moldboard trip capability even in such instances of center impacts where tripping of cutting edges 20, 22 is precluded, as depicted in FIGS. 14-16A. As illustrated in FIGS. 11, 12, 13, and 13A, a cutting edge 22 associated with one of the moldboards 14 of a V-blade snowplow 10 of the present disclosure, when the wings of the snowplow are in a V-formation, makes contact with an obstacle O having a height less than a height of the cutting edge 22. Upon contact with the obstacle O, the cutting edge 22 trips by rotating rearwardly to dissipate impact forces from contact with the obstacle O, reducing the transmission of the impact forces to the vehicle to which the V-blade snowplow 10 is mounted. However, when in the V-formation and the cutting edges 20, 22 associated with both of the moldboards 12, 14 simultaneously impact one or more obstacles O having a height lower than the height of the cutting edges 20, 22, as illustrated in FIGS. 14, 15, 16, and 16A, the cutting edges 20, 22 run the risk of binding against one another, at least momentarily preventing their tripping, but as illustrated in FIG. 15, the full moldboard trip capability is then triggered, thereby diminishing impact forces from the contact with the obstacle O.

While the present disclosure has been described with respect to certain embodiments, it will be understood that variations can be made thereto that are still within the scope of the appended claims.

We claim:

1. A V-blade snowplow comprising:

a first wing including a first moldboard and a first cutting edge hingedly mounted along a lower edge of the first moldboard, the hinged mounting including one or more trip edge springs biasing the first cutting edge into an untripped position in substantial alignment with a base of the first moldboard, but allowing the first cutting edge to trip upon impact with an obstacle;

a second wing including a second moldboard and a second cutting edge hingedly mounted along a lower edge of the second moldboard, the hinged mounting including one or more additional trip edge springs biasing the second cutting edge into an untripped position in substantial alignment with a base of the second moldboard, but allowing the second cutting edge to trip upon impact with an obstacle;

each of the first and second wings being hingedly secured to a center hinge, such that the first and second wings are adjustable with respect to one another; and one or more trip springs extending between the center hinge and a push frame, the trip springs and push frame permitting the first and second moldboards to trip upon impacts.

2. The V-blade snowplow of claim 1, wherein each of the first and second cutting edges has a maximum angle of deflection relative to the respective first and second moldboards in a range of 30° to 40°.

3. The V-blade snowplow of claim 2, wherein the maximum angle of deflection of each of the first and second cutting edges relative to the respective first and second moldboards is about 40°.

4. The V-blade snowplow of claim 1, wherein the one or more trip edge springs of the hinged mounting of each of the first and second cutting edges to the respective first and second moldboards include one or more torsion springs.

5. The V-blade snowplow of claim 4, wherein each of the one or more torsion springs has a stiffness of at least 68 lb.-in./deg.

6. The V-blade snowplow of claim 1, wherein the one or more trip edge springs extending between the center hinge and the push frame include one or more extension springs.

7. The V-blade snowplow of claim 6, wherein each of the one or more the extension springs has a stiffness of at least 145 lb./in.

8. A V-blade snowplow having a plurality of trip modes, including:

a first trip mode comprising a full moldboard trip capability, wherein upon an impact, both a first wing and a second wing of the V-blade snowplow pivot against a biasing force of at least one trip spring; and a second trip mode comprising a trip edge capability, wherein the first wing includes a first cutting edge hingedly mounted to a first moldboard, at least one trip edge spring biasing the first cutting edge toward an untripped position in substantial alignment with a base of the first moldboard, but allowing the first cutting edge to trip upon contact with an obstacle, and the second wing includes a second cutting edge hingedly mounted to a second moldboard, at least one additional trip edge spring biasing the second cutting edge toward an untripped position in substantial alignment with a base of the second moldboard, but allowing the second cutting edge to trip upon impact with an obstacle.

9. The V-blade snowplow of claim 8, wherein a maximum angle of deflection of each of the first and second cutting edges relative to the respective first and second moldboards is in a range of 30° to 40°.

10. The V-blade snowplow of claim 9, wherein the maximum angle of deflection of each of the first and second cutting edges relative to the respective first and second moldboards is about 40°.

11. The V-blade snowplow of claim 8, wherein each of the first and second cutting edges includes a plurality of bolt-receiving apertures therethrough along an upper edge thereof to facilitate securement of replacement cutting edges.

12. The V-blade snowplow of claim 8, being operable in the first and second trip modes simultaneously.

13. The V-blade snowplow of claim 8, wherein the one or more trip edge springs of the hinged mounting of each of the first and second cutting edges to the respective first and second moldboards include one or more torsion springs.

14. The V-blade snowplow of claim 8, wherein each of the trip edge springs and additional trip edge springs include one or more extension springs.

15. A dual trip V-blade snowplow assembly operable, upon impact with an obstacle, to mitigate forces transmitted to a vehicle associated with the snowplow assembly through a frame of the snowplow assembly, the assembly comprising:

a first wing including a first moldboard and a first cutting edge hingedly mounted along a lower edge of the first moldboard, the hinged mounting including one or more trip edge springs biasing the first cutting edge into an untripped position in substantial alignment with a base of the first moldboard, but allowing the first cutting edge to trip upon impact with an obstacle;

a second wing including a second moldboard and a second cutting edge hingedly mounted along a lower edge of the second moldboard, the hinged mounting including one or more additional trip edge springs biasing the second cutting edge into an untripped position in substantial alignment with a base of the second moldboard, but allowing the second cutting edge to trip upon impact with an obstacle;

each of the first and second wings being hingedly secured to a center hinge, such that the first and second wings are adjustable with respect to one another; and one or more trip springs extending between the center hinge and a push frame which frame is operable to mount to a plow-carrying vehicle, the one or more trip springs permitting the first moldboard and second moldboard to trip upon impacts.

16. A dual trip V-blade snowplow assembly operable, upon impact with an obstacle having a height less than a height of a cutting edge of the snowplow assembly to trip in a first mode, and further operable upon impact with an obstacle having a height greater than a height of a cutting edge of the snowplow assembly to trip in a second mode, comprising:

a first wing including a first moldboard and a first cutting edge hingedly mounted along a lower edge of the first moldboard, the hinged mounting including one or more trip edge springs biasing the first cutting edge into an untripped position in substantial alignment with a base of the first moldboard, but allowing the first cutting edge to trip upon impact with an obstacle having a height less than a height of the first cutting edge;

a second wing including a second moldboard and a second cutting edge hingedly mounted along a lower edge of the second moldboard, the hinged mounting including one or more additional trip edge springs biasing the second cutting edge into an untripped position in substantial alignment with a base of the second moldboard, but allowing the second cutting edge to trip upon impact with an obstacle having a height less than a height of the second cutting edge;

each of the first and second wings being hingedly secured to a center hinge, such that the first and second wings are adjustable with respect to one another; and one or more trip springs extending between the center hinge and a push frame which frame is operable to mount to a plow-carrying vehicle, the one or more trip springs permitting the first moldboard and second moldboard to trip upon impacts with an obstacle having a height greater than the height of the first or second cutting edge.

17. The dual trip V-blade snowplow assembly of claim 16, wherein each of the first cutting edge and the second cutting edge is a sacrificial wear element, and the one or more trip springs permitting the first moldboard and second moldboard to trip upon impacts with an obstacle having a height greater than the height of the first or second cutting edge even as the height of the first or second cutting edge diminishes due to wearing of the sacrificial wear element.

18. The dual trip V-blade snowplow assembly of claim 16, and wherein in the event of an impact with one or more obstacles of a height less than the height of the first or second cutting edges in a manner that causes binding together of adjacent portions of the first cutting edge and second cutting edge thereby impeding tripping of at least one of the first and second cutting edges, the one or more trip springs permit the first moldboard and second moldboard to trip.

19. The dual trip V-blade snowplow assembly of claim 16, wherein the impact force transmitted to a vehicle to which the snowplow assembly is secured upon contact with an obstacle by one of the first and second cutting edges when the vehicle is traveling between 5 and 14 MPH is 65% less than the impact force transmitted to the vehicle if the V-blade snowplow assembly had only an ability to trip in the first trip mode but not in the second trip mode.

20. A dual-trip V-blade snowplow assembly operable to mitigate the impact forces transmitted to the associated vehicle upon which the snowplow assembly mounts in use, comprising:

a first and a second plow wing, each carried by a center hinge for mounting to a vehicle plow push frame, the center hinge allowing relative angle adjustability of each wing with respect to the other wing, each wing formed with a trippable upper moldboard and a trippable lower cutting edge carried by the moldboard, and with one or more first trip springs mounted between the cutting edge and the moldboard to allow tripping by the cutting edge about a cutting edge rotation axis for tripping upon snowplow assembly impact with obstacles having a height less than a height of the cutting edge, and one or more second trip springs mounted between the moldboard and the center hinge to allow tripping by the moldboard about a moldboard rotation axis for tripping upon at least one of snowplow assembly impact with obstacles having a height greater than the height of the cutting edge, upon impacts generating forces greater than a predetermined threshold, or, at least when the wings are arranged in a V-orientation, upon impact with obstacles that cause the cutting edge of one of the wings to bind with the cutting edge of the other of the wings thereby impeding tripping by one or both of the cutting edges.

21. The dual-trip V-blade snowplow assembly of claim 20, wherein the moldboard rotation axis is higher than the cutting edge rotation axis, and wherein the stiffness of each of the one or more second trip springs is greater than the stiffness of each of the one or more first trip springs.

22. The snowplow assembly of claim 20, wherein the first trip springs are torsion springs.

23. The snowplow assembly of claim 20, wherein the second trip springs are extension springs.

24. The snowplow assembly of claim 20, and wherein each cutting edge is formed as a sacrificial wear element, and wherein even as the height of the cutting edge rotation axis lessens as the wear element wears down in use, the snowplow assembly, due to moldboard tripping capability, still possesses a tripping capability even upon impacts with obstacles of greater height than a diminished height of the cutting edges.

* * * * *

UNITED STATES PATENT AND TRADEMARK OFFICE

CERTIFICATE OF CORRECTION

PATENT NO. : 9,051,700 B2
APPLICATION NO. : 13/783206
DATED : June 9, 2015
INVENTOR(S) : Summers et al.

It is certified that error appears in the above-identified patent and that said Letters Patent is hereby corrected as shown below:

In the Claims:

Column 6, line 62, claim 7 “the extension” should be -- extension --.

Signed and Sealed this
Twenty-third Day of February, 2016

Michelle K. Lee

Michelle K. Lee
*Director of the United States Patent and Trademark Office*